US008794800B2

(12) United States Patent
Chen

(10) Patent No.: US 8,794,800 B2
(45) Date of Patent: Aug. 5, 2014

(54) LAMP SHIELD

(75) Inventor: Yu-Ta Chen, Kaohsiung (CN)

(73) Assignee: Tsair Yih Industrial Co., Ltd, Kaohsiung (TW)

( * ) Notice: Subject to any disclaimer, the term of this patent is extended or adjusted under 35 U.S.C. 154(b) by 79 days.

(21) Appl. No.: 13/697,373

(22) PCT Filed: Oct. 18, 2010

(86) PCT No.: PCT/CN2010/077816

§ 371 (c)(1),
(2), (4) Date: Nov. 12, 2012

(87) PCT Pub. No.: WO2011/143894

PCT Pub. Date: Nov. 24, 2011

(65) Prior Publication Data

US 2013/0063954 A1 Mar. 14, 2013

(30) Foreign Application Priority Data

May 18, 2010 (CN) ..... 2010 2 0193667 U

(51) Int. Cl.
*F21V 13/10* (2006.01)
*F21S 8/08* (2006.01)
*F21V 7/04* (2006.01)

(52) U.S. Cl.
CPC *F21S 8/081* (2013.01); *F21V 7/041* (2013.01)
USPC ..... 362/343; 362/186; 362/187; 362/349

(58) Field of Classification Search
CPC ..... F21S 8/081; F21V 7/041; F21V 12/04
USPC ..... 362/343, 349, 186, 187
See application file for complete search history.

(56) References Cited

U.S. PATENT DOCUMENTS

| | | | | |
|---|---|---|---|---|
| 1,904,248 | A * | 4/1933 | Bender et al. | 362/186 |
| 5,165,781 | A * | 11/1992 | Orak | 362/186 |
| 5,384,694 | A * | 1/1995 | Yang | 362/298 |
| 5,690,414 | A * | 11/1997 | Jeng | 362/120 |
| 6,283,611 | B1 * | 9/2001 | Sharrah et al. | 362/205 |
| 7,473,007 | B1 * | 1/2009 | Wang | 362/187 |
| 2011/0182061 | A1 * | 7/2011 | Loibl | 362/186 |
| 2011/0255280 | A1 * | 10/2011 | Chen | 362/235 |
| 2013/0235564 | A1 * | 9/2013 | Barcelos et al. | 362/151 |

* cited by examiner

*Primary Examiner* — Anabel Ton
(74) *Attorney, Agent, or Firm* — Leong C. Lei

(57) ABSTRACT

A lamp shield (1) for coupling to an illuminating device (2) includes a housing (21) and a light source (22) disposed in the housing (21). The lamp shield (1) includes a top wall (11) having a reflecting surface (114) for facing the light source (22), and a surrounding wall (12) connected to the top wall (11). The surrounding wall (12) has a light transmissive portion (121), and an engaging portion (122) respectively proximate to and distal from the top wall (11). The engaging portion (122) has at least one slit (14) extending from a bottom edge (17) thereof toward the light transmissive portion (121), and is for engaging the housing (21). The light transmissive portion (121) includes a plurality of connecting ribs (123) interconnecting the top wall (11) and the engaging portion (121), and a plurality of light-passage holes (124) alternating with the connecting ribs (123).

8 Claims, 5 Drawing Sheets

LAMP SHIELD

The invention relates to a lamp shield, more particularly to a lamp shield adapted to be mounted on an illuminating device to provide the illuminating device with another way of illumination.

Commercially available illuminating devices have developed into various types for different purposes. For example, some illuminating devices are mounted on ceilings and walls of a building for indoor illumination, some illuminating devices are disposed on a desk for local illumination, and some portable illuminating devices such as flashlights and warning lights are for outdoor use so as to provide condense illumination.

However, each of the abovementioned illuminating devices is for a particular use. For example, the flashlights that provide condense illumination cannot serve as the lamps that provide even illumination. As a result, the application range of the illuminating devices is limited.

Therefore, the object of the invention is to provide a lamp shield capable of alleviating the above drawbacks of the prior art.

Accordingly, a lamp shield of the present invention is adapted to be coupled to an illuminating device and that includes a housing and a light source disposed in the housing. The lamp shield includes a top wall having a reflecting surface that is adapted for facing the light source, and a surrounding wall surrounding an axis and connected to and cooperating with the top wall to define an inner space therein. The surrounding wall has a light transmissive portion that is proximate to the top wall along the axis, and an engaging portion that is distal from the top wall along the axis. The engaging portion has a bottom edge opposite to the light transmissive portion along the axis, is formed with at least one slit extending from the bottom edge toward the light transmissive portion along the axis, and is adapted to engage the housing of the illuminating device. Light projected by the light source is transmitted into the inner space and reflected by the reflecting surface and travels outwardly of the light transmissive portion. The light transmissive portion of the surrounding wall includes a plurality of angularly spaced-apart connecting ribs that interconnect the top wall and the engaging portion of the surrounding wall, and a plurality of light-passage holes that are angularly spaced apart from each other and that alternate with the connecting ribs.

Other features and advantages of the invention will become apparent in the following detailed description of the preferred embodiments with reference to the accompanying drawings, of which:

Before the invention is described in greater detail with reference to the accompanying embodiments, it should be noted herein that like elements are denoted by the same reference numerals throughout the disclosure.

Figure 1:
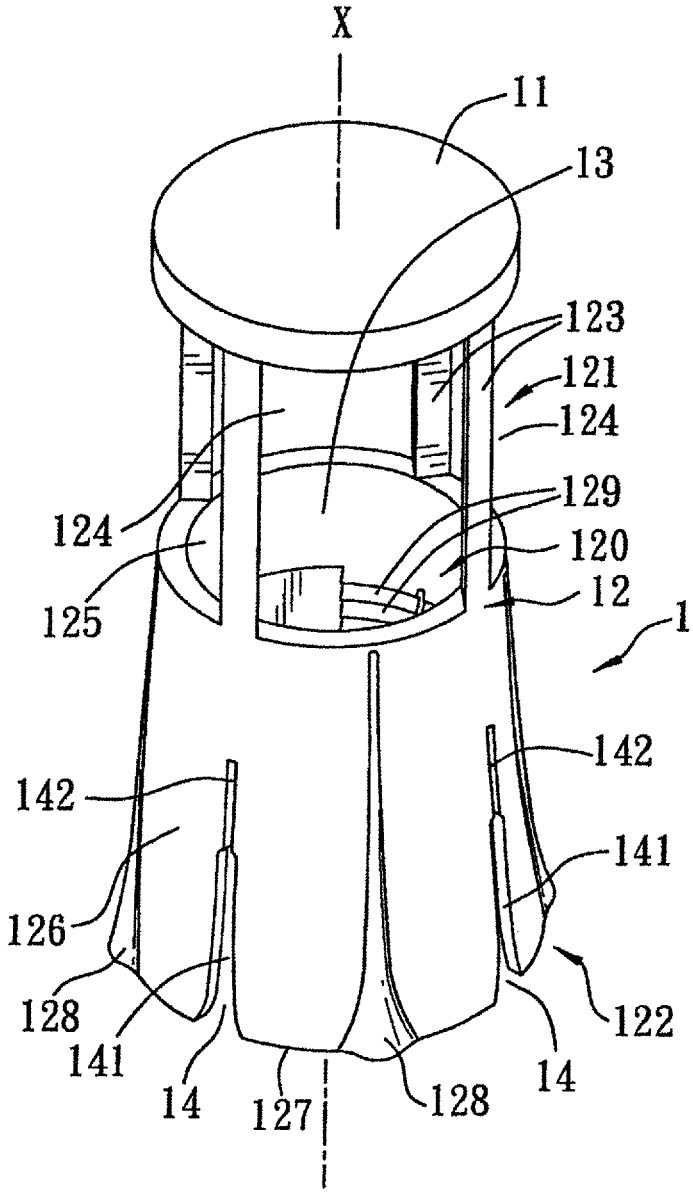
FIG. 1 is a perspective view of a first preferred embodiment of a lamp shield according to the present invention.
Figure 2:
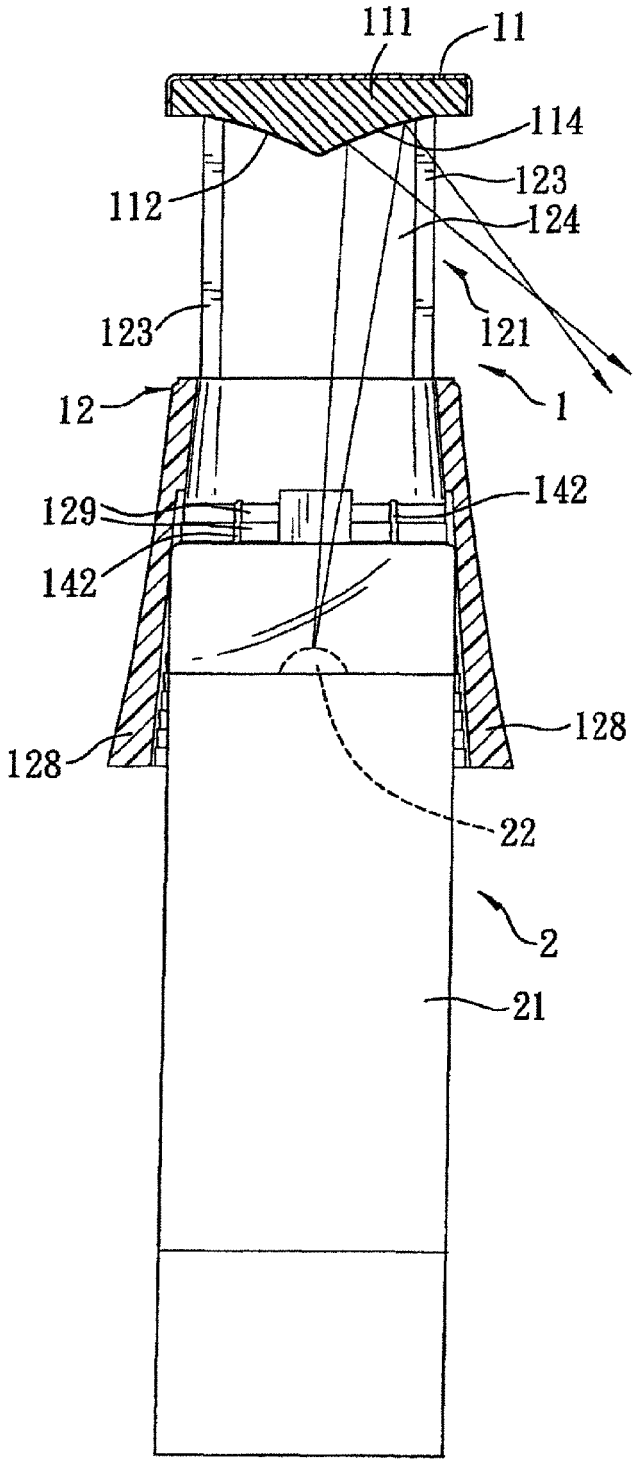
FIG. 2 is a sectional view of the first preferred embodiment coupled to an illuminating device.
Figure 3:
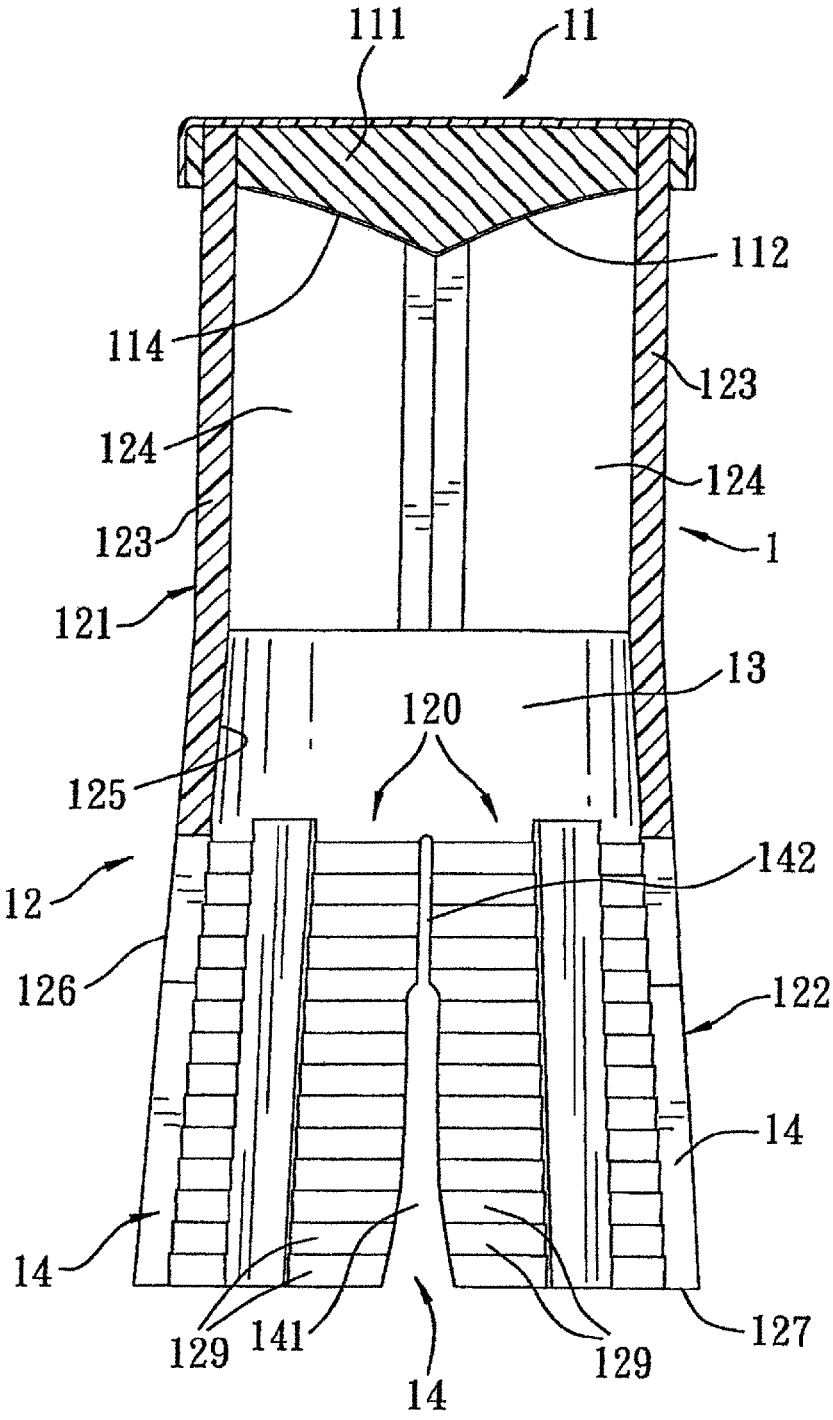
FIG. 3 is another sectional view of the first preferred embodiment.

Referring to FIGS. 1 to 3, a first preferred embodiment of a lamp shield 1 according to the present invention is adapted to be coupled to an illuminating device 2. The illuminating device 2 is a flashlight that includes a housing 21 and a light source 22 disposed in the housing 21 in this embodiment.

The lamp shield 1 comprises a top wall 11 and a surrounding wall 12 that surrounds an axis (X), and that is connected to and cooperates with the top wall 11 to define an inner space 13 therein.

The top wall 11 has a main part 111 and a reflecting part 112. The main part 111 is made of plastic and is connected to the surrounding wall 12. The reflecting part 112 is connected to the main part 111 and is formed with a reflecting surface 114 adapted for facing the light source 22 of the illuminating device 2. The reflecting surface 114 is configured as a cone that converges toward the light source 22 and that is covered by an electroplated layer. The surrounding wall 12 can be welded to the main part 111 of the top wall 11, or be connected integrally to the top wall 11.

The surrounding wall 12 has a light transmissive portion 121 that is proximate to the top wall 11 along the axis (X), and an engaging portion 122 that is distal from the top wall 11 along the axis (X) and that is adapted to engage the housing 21 of the illuminating device 2.

The light transmissive portion 121 of the surrounding wall 12 includes a plurality of angularly spaced-apart connecting ribs 123 that interconnect the top wall 11 and the engaging portion 122 of the surrounding wall 12, and a plurality of light-passage holes 124 that are angularly spaced apart from each other and that alternate with the connecting ribs 123.

In this embodiment, the engaging portion 122 is formed with a plurality of angularly spaced-apart slits 14 and has a bottom end part, an inner surrounding surface 125, an outer surrounding surface 126, a bottom edge 127, a plurality of reinforcement ribs 128, and a plurality of engaging step units 120. The inner surrounding surface 125 is formed in the bottom end part confronts the inner space 13, and the outer surrounding surface 126 is opposite to the inner surrounding surface 125. The bottom edge 127 is opposite to the light transmissive portion 121 along the axis (X).

The slits 14 extend from the bottom edge 127 toward the light transmissive portion 121 along the axis (X) and are aligned respectively with the connecting ribs 123. Each of the slits 14 has a large slit section 141 that extends from the bottom edge 127 of the engaging portion 122, and a small slit section 142 that extends from the large slit section 141 toward the light transmissive portion 121 of the surrounding wall 12, and that has a dimension smaller than that of the large slit section 141. The reinforcement ribs 128 protrude from the outer surrounding surface 126 and are arranged alternately with the slits 14. The engaging step units 120 are formed on the inner surrounding surface 125 and each of the engaging step units 120 has a plurality of juxtaposed engaging steps 129 that extend circumferentially and that are for engaging detachably the housing 21 of the illuminating device 2. The engaging step units 120 are disposed at a height substantially the same as the length of each slits 14.

By virtue of the slits 14, when the engaging portion 122 of the surrounding wall 12 is coupled to a top end of the housing 21 of the illuminating device 2, the resiliency of the surrounding wall 12 is improved. Further, the engaging step units 120 improve the stability of engagement between the surrounding wall 12 of the lamp shield 1 and the illuminating device 2. Therefore, the light beam (indicated by an arrow shown in FIG. 2) emitted by the light source 22 is transmitted to and reflected by the reflecting surface 124, and further travels outwardly of the lamp shield 1 through the light-passage holes 124 to thereby provide even illumination intensity. As a result, when the illuminating device 2 such as the flashlight that provides condense illumination is used with the lamp shield 1 of this invention, the light beam transmitted out of the lamp shield 1 is even and soft, and the illuminating device 2 can be used as a lamp, especially when power failure occurs and outdoor use is require.

Figure 4:
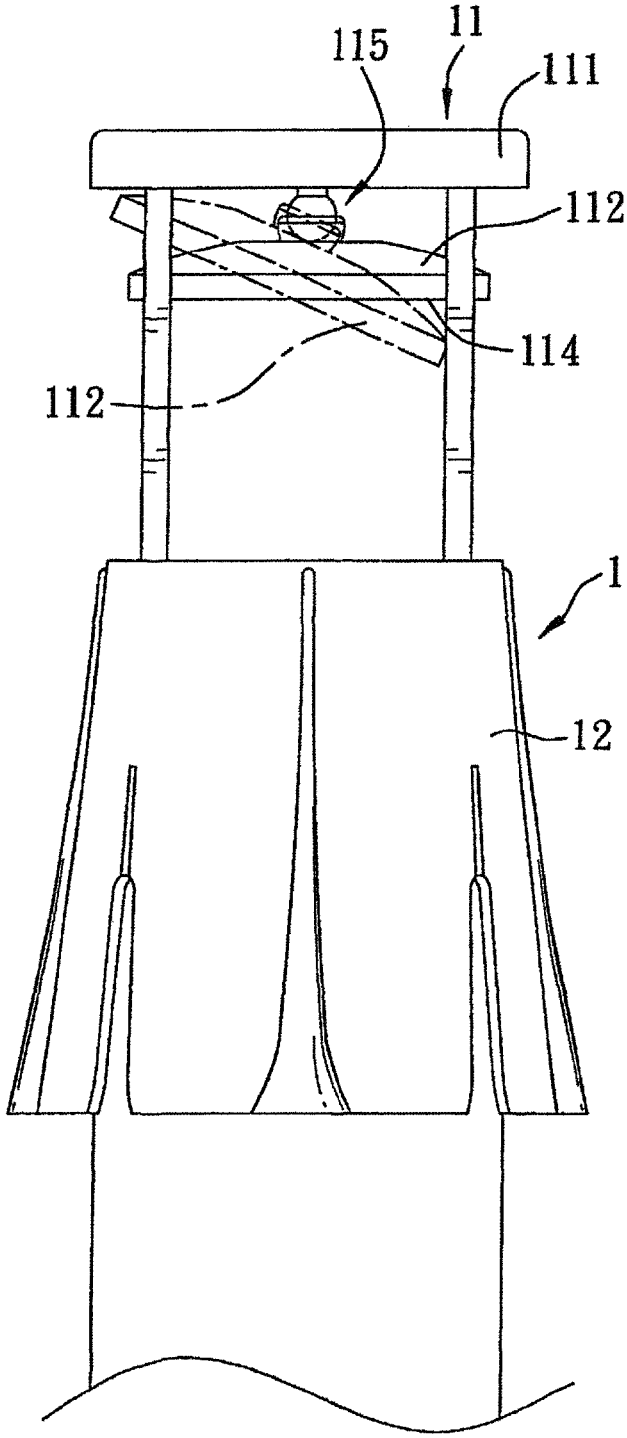
FIG. 4 is a schematic side view of a second preferred embodiment of a lamp shield according to the present invention.
Figure 5:
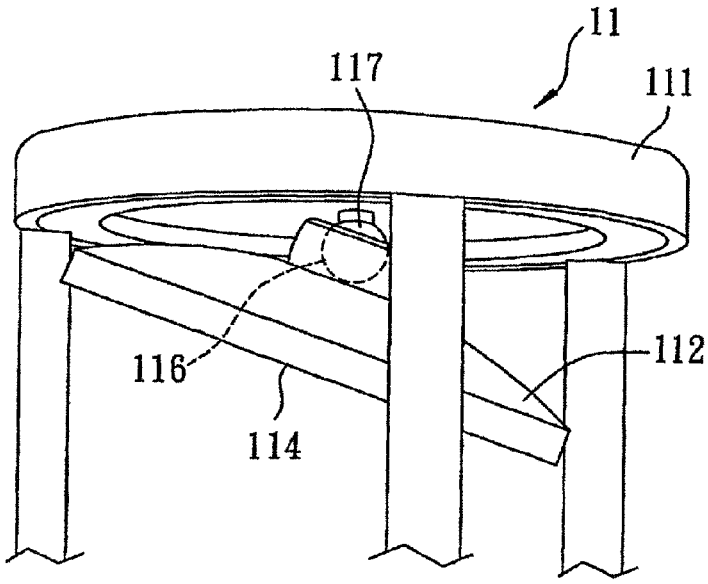
FIG. 5 is a fragmentary perspective view of the second preferred embodiment.

Referring to FIGS. 4 and 5, a second preferred embodiment of the lamp shield 1 according to the present invention has a structure similar to that of the first embodiment. The main difference between this embodiment and the first embodiment resides in the following. In this embodiment, the top wall 11 includes a main part 111 that is connected to the surrounding wall 12, a reflecting part 112 that is disposed under the main part 111 and that is formed with the reflecting surface 114, and an angel adjusting portion 115 that connects the reflecting part 112 to the main part 111. In this embodiment, the reflecting surface 114 is configured as a flat surface, and the angle adjusting portion 115 is configured as a ball-and-socket joint that includes a socket 116 and a ball 117. The ball 117 is disposed on the main part 111, and the socket 116 is disposed on a top surface of the reflecting part 112 and engages rotatably the ball 117, so that the angle of the reflecting surface 114 relative to the main part 111 is adjustable freely as required. The second preferred embodiment has the same advantages as those of the first preferred embodiment.

The invention claimed is:

1. A lamp shield adapted to be coupled to an illuminating device including a housing and a light source that is disposed in the housing, said lamp shield being characterized by:

a top wall having a reflecting surface that is adapted for facing the light source; and a surrounding wall surrounding an axis, connected to and cooperating with said top wall to define an inner space therein, and having a light transmissive portion that is proximate to said top wall along the axis, and an engaging portion that is distal from said top wall along the axis, that has a bottom edge opposite to said light transmissive portion along the axis, that is formed with at least one slit extending from said bottom edge toward said light transmissive portion along the axis, and that is adapted to engage the housing of the illuminating device;

light projected by the light source being transmitted into said inner space, reflected by said reflecting surface and traveling outwardly of said light transmissive portion wherein said light transmissive portion of said surrounding wall includes a plurality of angularly spaced-apart connecting ribs that interconnect said top wall and said engaging portion of said surrounding wall, and a plurality of light-passage holes that are angularly spaced apart from each other and that alternate with said connecting ribs.

2. The lamp shield as claimed in claim 1, further characterized in that said engaging portion of said surrounding wall is formed with a plurality of said slits aligned respectively with said connecting ribs, each of said slits having a large slit section that extends from said bottom edge of said engaging portion and a small slit section that extends from said large slit section toward said light transmissive portion of said surrounding wall and that has a dimension smaller than that of said large slit section.

3. The lamp shield as claimed in claim 2, further characterized in that said engaging portion of said surrounding wall further has a bottom end part, an inner surrounding surface that is formed in said end part and that confronts said inner space, and a plurality of engaging step units formed on said inner surrounding surface, each of said engaging step units having a plurality of juxtaposed engaging steps that extend circumferentially and that are adapted for engaging detachably the housing of the illuminating device.

4. The lamp shield as claimed in claim 3, further characterized in that said engaging portion of said surrounding wall further has an outer surrounding surface opposite to said inner surrounding surface and a plurality of reinforcement ribs protruding from said outer surrounding surface and arranged alternately with said slits.

5. The lamp shield as claimed in claim 4, further characterized in that said top wall has a main part that is connected to said surrounding wall and a reflecting part that is connected to said main part and that is formed with said reflecting surface, said reflecting surface being shaped as a cone that converges toward the light source.

6. The lamp shield as claimed in claim 1, further characterized in that said surrounding wall is formed with a plurality of said slits, said engaging portion further having an outer surrounding surface and a plurality of reinforcement ribs protruding from said outer surrounding surface and arranged alternately with said slits.

7. The lamp shield as claimed in claim 1, characterized in that said top wall includes a main part that is connected to said surrounding wall, a reflecting part that is disposed under said main part and that is formed with said reflecting surface, and an angle adjusting portion that connects said reflecting part to said main part.

8. The lamp shield as claimed in claim 7, further characterized in that said angle adjusting portion is configured as a ball-and-socket joint.

* * * * *